US010807687B2

(12) United States Patent
Xiao

(10) Patent No.: US 10,807,687 B2
(45) **Date of Patent: *Oct. 20, 2020**

(54) SNORKEL MASK

(71) Applicant: Wenzi Xiao, Shenzhen (CN)

(72) Inventor: Wenzi Xiao, Shenzhen (CN)

( * ) Notice: Subject to any disclaimer, the term of this patent is extended or adjusted under 35 U.S.C. 154(b) by 382 days.

This patent is subject to a terminal disclaimer.

(21) Appl. No.: 15/789,717

(22) Filed: Oct. 20, 2017

(65) Prior Publication Data

US 2019/0118915 A1 Apr. 25, 2019

(51) Int. Cl.
*B63C 11/16* (2006.01)
*B63C 11/12* (2006.01)

(52) U.S. Cl.
CPC ..... *B63C 11/16* (2013.01); *B63C 2011/128* (2013.01); *B63C 2011/165* (2013.01)

(58) Field of Classification Search
CPC ..... B63C 11/16; B63C 2011/128; B63C 2011/165; B63C 11/18; B63C 11/02; B63C 11/12; B63C 11/00; B63C 11/186; B63C 2011/125; B63B 2730/00
See application file for complete search history.

(56) References Cited

U.S. PATENT DOCUMENTS 4,896,380 A * 1/1990 Kamitani ..... A61F 9/029 128/864
5,181,506 A * 1/1993 Tardiff, Jr. ..... A61F 9/02 128/201.22
2016/0297505 A1* 10/2016 Caprice ..... B63C 11/16
2017/0334531 A1* 11/2017 Shiue ..... B63C 11/16
2018/0297676 A1* 10/2018 Zheng ..... B63C 11/14
2019/0002068 A1* 1/2019 Godoy ..... B63C 11/16

* cited by examiner

*Primary Examiner* — Timothy A Stanis
*Assistant Examiner* — Arielle Wolff
(74) *Attorney, Agent, or Firm* — Jeffrey G. Degenfelder; Carstens & Cahoon, LLP

(57) ABSTRACT

A snorkel mask is disclosed comprising a faceplate having a lateral partition on an interior surface delineating an upper and lower section, the lower section comprising a region that extends away from the upper section and includes a cutout section fitted with a complementary-shaped flexible insert that enables a user to grasp the nose. The snorkel mask further includes a rigid frame bonded to the faceplate and sandwiched between the faceplate and a flexible annular sidewall skirt that is hollow and filled with a gas or other cushioning substance. The flexible skirt includes a lateral nose piece section attached to the partition. The lateral nose piece section having an inlet aperture and check valve for inhaled air, and an orifice through which an exhalation conduit extends from the lower chamber to a snorkel device forming a passageway for exhaled air to pass through the upper chamber to the snorkel device.

21 Claims, 7 Drawing Sheets

SNORKEL MASK

BACKGROUND OF THE INVENTION

1. Technical Field of the Invention

The present invention relates to a diving mask used for snorkeling and, more particularly, to an improved full-face snorkel mask that allows both mouth and nasal breathing.

2. Description of Related Art

Snorkeling allows observation of marine life while swimming on the surface of the water or at moderate depths. When snorkeling, in order to prevent water getting into the eyes, ears and mouth, most divers use a snorkel mask. Snorkeling masks have long been popular for providing a simple and cheap way to see underwater clearly when swimming. Typically, snorkeling masks comprise a face mask for viewing and a snorkel device for breathing. One drawback of conventional snorkeling masks is that they typically offer a limited field of view. Another shortcoming of conventional snorkeling masks is its fixed-shape silicon frame, which is not always suited to the different face contours of different users. When a silicone frame does not match the contours of a diver's face, water leakage often occurs resulting in water entering the interior of the diver's mask, negatively affecting its normal use. Still another drawback of the conventional snorkel device is that the breathing tube fits in the mouth so that the diver can only breathe through the mouth.

More recently, full-face snorkeling masks incorporating a snorkel device and offering improved visibility and the ability to breathe through the nose and mouth have begun to appear in the marketplace. One such example is disclosed in U.S. Publ. 2016/0297505 to Caprice et al. This mask includes a faceplate surrounded by a hollow frame assembly; a flexible skirt mounted on the frame assembly, the flexible skirt having a sealing lip about its inner periphery and comprising a lateral partition delimiting an upper chamber and a lower chamber, the partition being arranged to bear upon the top of a user's nose when the mask is worn by the user so that the user's mouth and nose are positioned within the lower chamber, the partition having at least one passageway arranged to allow circulation of air from the upper chamber to the lower chamber during an inhalation phase; a conduit having an inlet channel enabling entry of ambient air and a first escape channel enabling exit of exhaust air, the conduit being configured on the exterior of the mask's upper and lower chambers and extending at an upper part of the hollow frame assembly, the inlet channel being in fluid communication with the upper chamber, and the first escape channel being in fluid communication with the lower chamber, the hollow frame assembly comprising at least one air duct, the air duct having an upper end opening into the first escape channel, and a lower end opening into the lower chamber.

While an improvement on the prior art snorkel masks, the mask disclosed in the Caprice et al. '505 reference still has a number of deficiencies. For example, the hollow frame assembly configured about the outer periphery of the mask is excessively large and bulky due to its incorporation of a complex system of breathing conduits and a snorkel coupling sleeve. In addition, the flexible skirt comprises a peripheral sealing lip constructed of a single silicone layer that is arranged to bear against the user's face so as to prevent water from entering between the user's face and the faceplate. However, since it is a single layer, the sealing lip is susceptible to not matching the contours of a diver's face causing leakage in the mask. In addition, because the lower portion of the mask disclosed in the Caprice et al. '505 reference is entirely enclosed behind the rigid faceplate, a user is unable to readily pinch his nose to clear his ears (i.e., equalize the pressure between the ears and sinuses) when diving to depths, without having to remove the mask. The inability to perform the valsalva procedure while wearing the Caprice mask would cause a user to experience pain and discomfort due to water pressure when they are snorkeling in water of any depth.

Therefore, it is an objective of the invention to provide a full-faced snorkel mask to mitigate and/or obviate the aforementioned problems.

SUMMARY OF THE INVENTION

The present invention overcomes many of the aforementioned disadvantages of prior art by providing a full-face snorkeling mask with superior sealing qualities that is more streamlined and efficient. The individual parts of the mask of the present invention are preferably fused together using injection molding techniques to create a unitary mask body. The improved mask includes a faceplate that incorporates a lateral partition on the interior surface that delineates an upper section from a lower section. A snorkel coupling and passageway is also incorporated into the upper portion of the faceplate. While the upper portion of the faceplate includes a transparent lens section, the lower portion includes a region that extends away from the transparent lens section and features a cutout having a flexible insert installed therein which allows the user to readily squeeze the nose when necessary to equalized pressure on the eardrums. The faceplate may also comprise a drainage or purge valve arranged in the lower or breathing chamber to evacuate liquid to outside the mask. The faceplate also incorporates two or more buckle devices for attaching elastic retention straps to the mask.

The faceplate includes a flange that is formed along the entire outer periphery or rim of the faceplate. The flange is used as a bonding surface to mount and bond the faceplate to a rigid frame configured about the entire periphery of the faceplate. The rigid frame provides structural support to the faceplate while remaining contained within the circumference of the outer periphery of the faceplate. Preferably, the rigid frame is permanently bonded to the flange of the faceplate.

The mask of the present invention further includes a flexible annular sidewall element or skirt that is affixed to the rigid frame. The flexible annular skirt is hollow and filled with a gas or other cushioning substance so as to seal the mask to the diver's face while providing a comfortable, ergonomic and waterproof interface with the diver's face. The flexible sealing skirt also includes a lateral nose piece section, attached to the partition of the faceplate, which effectively seals off the upper chamber from the lower chamber when the mask is worn. The lateral nose piece section includes a barrier wall section that is attached to the partition. The lateral nose piece is formed or sculpted so as come in sealing contact with the user's face in the nasal region just above the user's nose.

The barrier wall section of the lateral nose piece section includes at least one aperture, which allows inhaled air from the snorkel device to travel through the upper chamber to the lower chamber. Each aperture also comprises a check valve device which allows the circulation of inhaled directed through each aperture solely from the upper chamber towards the lower chamber during an inhalation phase by the user. By means of the check valve device, the aperture is closed off during an exhalation phase preventing the flow of exhaled air from rising back into the upper chamber, thereby improving the efficacy of the anti-fogging system of the mask. In a preferred embodiment, the barrier wall section of the lateral nose piece section includes two apertures with matching check valve devices.

The barrier wall section of the lateral nose piece section further includes at least one orifice through which an exhalation conduit extends from the lower chamber to the snorkel device forming a passageway for exhaled air to pass through the upper chamber to the snorkel device. The passageway allows warm, humid air exhaled by the user to be efficiently exhausted though the snorkel without fogging up the transparent lens of the mask. In a preferred embodiment, the lateral nose piece section includes two orifices and matching conduits.

A snorkel device is connected via a snorkel coupling formed in the upper portion of the faceplate. The snorkel device has a ventilation system that provides an air pathway into and out of the mask. In a preferred embodiment, the snorkel device comprises an elongated body which slidably couples to the snorkel coupling on one end and comprises an air-permeable enclosure on the distal end. The elongated body encloses an air passageway which fluidly connects a passageway in the snorkel coupling with the airway inlet near the distal end of the snorkel device.

In a preferred embodiment, the snorkel device provides separate pathways for inhaled and exhaled air. The snorkel device may have a distal end having an air-permeable enclosure. The snorkel device further comprises a shut-off device that is mobile within the enclosure so that when the snorkel is submerged in water the shut-off device is caused to move and close the inlet to the air passageway in the snorkel. Nonetheless, the snorkel device is constructed so that when the user exhales air while under water the inlet may be momentarily forced open to exhaust the air.

When the snorkel device is out of the water, the shut-off device does not cover the inlet to the air passageway in the snorkel allowing fresh air be inhaled through the air passageway and into the mask via the upper chamber through the aperture and into the lower chamber.

In a preferred embodiment, the snorkel device is removable from the snorkel coupling formed in the upper portion of the faceplate.

The flexible hollow skirt and the flexible insert configured in the faceplate may be made of silicone while the frame and faceplate may be made of rigid plastic such as polypropylene or polycarbonate. The arrangement is advantageous since it allows a mask to be manufactured using a minimum number of parts. Preferably the parts are fused together using injection molding techniques to create a unitary mask body.

The mask of the present invention may also comprise an elastic retention strap which extends between two or more buckle devices incorporated into the faceplate of the mask. In a preferred embodiment, the mask includes two buckle devices extending from the upper portion of the faceplate and two buckle devices extending from the lower portion of the faceplate.

In a preferred embodiment, the elastic retention strap may comprise two elastic retention straps bonded together in the center of both straps. The elastic strap is therefore X-shaped making it possible to cover the rear part of the user's head, thereby providing stable maintaining of the mask on the user's head. A first elastic retention strap having one end attached to a buckle device extending from the upper portion of a first side of the faceplate and a second end attached to a buckle device extending from the lower portion of a first side of the faceplate. A second elastic retention strap having one end attached to a buckle device extending from the upper portion of a second side of the faceplate and a second end attached to a buckle device extending from the lower portion of a second side of the faceplate. This preferred embodiment facilitates the mounting operation of the elastic strap and the holding in place thereof in relation to the mask.

BRIEF DESCRIPTION OF THE DRAWINGS

A more complete understanding of the apparatus of the present invention may be had by reference to the following detailed description when taken in conjunction with the accompanying drawings, wherein.

Figure 1:
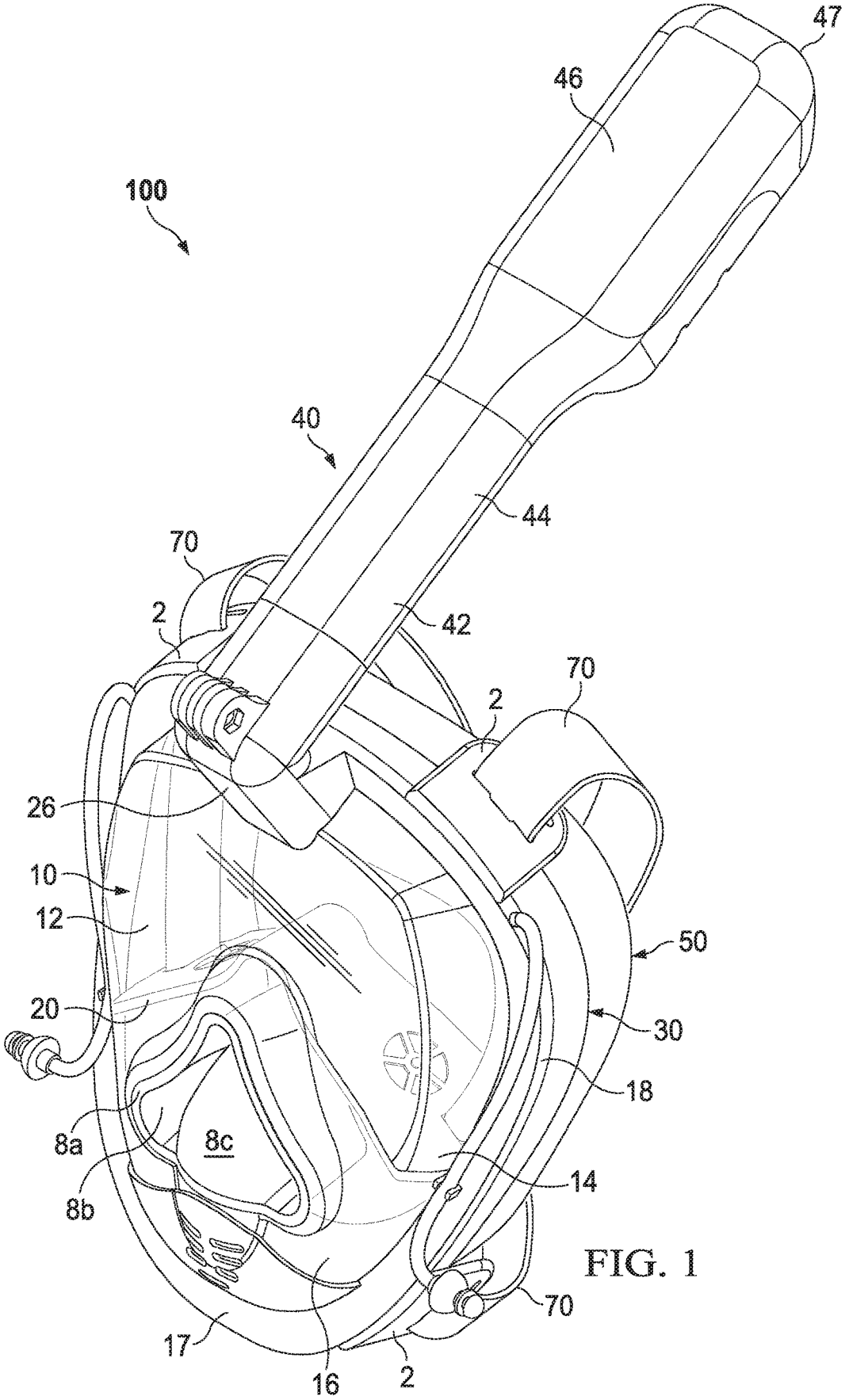
FIG. 1 is a front perspective view of an embodiment of the snorkel mask of the present invention.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

FIG. 1 depicts an example of an embodiment of a full-faced snorkel mask 100 conforming to embodiments of the present disclosure. With reference now to the Figures, and in particular, FIGS. 1-6, the snorkel mask 100 comprises a faceplate 10 affixed to a rigid frame 30, which in turn is sandwiched between the faceplate 10 and a flexible annular sidewall element or skirt 50.

The of the faceplate body 10 includes a lateral partition 20 on the interior side of the faceplate 10 that delineates an upper chamber 22 from a lower or breathing chamber 24. As will be understood with reference to FIG. 4, the user's mouth and nose are positioned in the lower chamber 24, whereas the user's eyes are positioned in the upper chamber 22. A snorkel coupling 26 is also incorporated into the upper portion 14 of the faceplate 10. The snorkel coupling 26 includes a passageway 27 that fluidly connects the upper chamber 22 to a snorkel device 40. The upper portion 14 of the faceplate 10 includes a transparent lens section 12, while the lower portion 16 of the faceplate 10 includes a region 5 that extends away from the transparent lens section 12 and includes a cutout or opening 6 positioned about the user's mouth and nasal region when worn. A flexible waterproof insert 8 is installed in the cutout opening 6 that allows the user to readily squeeze the user's nose when necessary to equalized pressure on the eardrums. The insert 8 includes an outer peripheral edge or rim 8*a* that is complementary to the shape and dimension to the cutout opening 6 in the faceplate 10. The insert 8 is bonded to the cutout opening 6 along the outer peripheral edge or rim 8*a* with a waterproof seal. The insert may also include thin-walled recessed portions 8*b* and a thin-walled bulbous nose section 8*c*, which enables a user's to perform the Valsalva maneuver with their hands by grabbing the nose through the thin-walled bulbous nose section 8*c*. While the preferred embodiment shown in the Figures comprises a generally triangular shaped cutout opening 6 and insert 8, it is understood that they could conceivably be of any complementary geometric shape.

The faceplate 10 also incorporates two or more buckle devices 2 for attaching an elastic retention strap 70 to the mask. The faceplate 10 may also comprise a drainage or purge valve 4 configured in the lower portion 16 of the faceplate 10 and arranged to evacuate liquid from the lower or breathing chamber 24 to outside the mask 100. Water contained in the lower chamber 16 can be expelled to outside the mask 100 via the purge valve 4 by means of sharp exhalation.

A flange 17 is formed along the entire outer periphery or rim 18 of the faceplate 10. The flange 17 is used as a bonding surface to affix the faceplate 10 to a rigid oblong-shaped frame 30 configured about the entire periphery of the flange 17 of the faceplate 10. The rigid frame 30 provides structural support to the faceplate 10 while remaining contained within the circumference of the outer periphery 18 of the faceplate 10. Preferably, the rigid frame 10 is permanently bonded to the outer periphery flange 17 of the faceplate 10.

The mask 100 of the present invention further includes a flexible annular sidewall element or skirt 50 that is affixed to the rigid frame 30. The flexible annular skirt 50 is hollow and filled with a gas or other cushioning substance so as to seal the mask to the diver's face while providing a comfortable, ergonomic and waterproof interface with the diver's face. Preferably, the flexible annular skirt 50 is filled with air or a gel material. The flexible annular skirt 50 is of general oblong annular shape having substantially the same circumferential dimensions as faceplate 10 and the frame 30.

The flexible sealing skirt 50 also includes a lateral nose piece section 54 attached to the partition 20 of the faceplate 10. The lateral nose piece section 54 effectively seals off at the partition 20 the upper chamber 22 from the lower chamber 24 when the mask 100 is worn. The lateral nose piece section 54 includes barrier wall section 56 that is preferably flexible, and fixably attached and bonded to the partition 20. The lateral nose piece 54 is formed or sculpted so as come in sealing contact with the user's face in the nasal region just above the user's nose.

The barrier wall section 56 is of the lateral nose piece section 54 includes at least one intake aperture 55, which allows air to be inhaled from the snorkel device 40. The inhaled air from the snorkel device 40 enters the mask 100 via the passageway 27 formed the snorkel coupling 26 and travels through the upper chamber 22 to the lower chamber 24 through the intake aperture 55. Each intake aperture 55 in the lateral nose piece section 54 also comprises a check valve device 59 which controls the flow of inhaled air directed through each intake aperture 55 solely from the upper chamber 22 towards the lower chamber 24 during an inhalation phase by the user. By means of the check valve device 59, the intake aperture 55 is sealed during an exhalation phase by the user preventing the flow of exhaled air from rising back into the upper chamber 22, thereby improving the effectiveness of the anti-fogging system of the mask 100. In a preferred embodiment, the barrier wall section 56 of the lateral nose piece section 54 includes two intake apertures 55 and matching check valve devices 59.

The barrier wall section 56 of the lateral nose piece section 54 further includes at least one exhaust orifice 58 through which an exhaust conduit 60 extends from the lower chamber 24 through the upper chamber 22 and to the passageway 27 contained in the snorkel coupling 26 forming an enclosed passageway for exhaled air to pass through the upper chamber 22 to the snorkel device 40. The enclosed passageway 60 allows warm, humid air exhaled by the user to be efficiently exhausted though the snorkel device 40 without fogging up the transparent lens section 12 of the mask 100. As shown in the Figures, and particularly FIG. 4, the exhaust conduit 60 is configured about the inner periphery of the upper chamber 22 adjacent to the flexible annular sidewall element 50. The lower end 62 of the enclosed passageway 60 is sealed within the exhaust orifice 58 of the barrier wall section 56, while the upper end 64 is configured within the passageway 27 of the snorkel coupling 26. In a preferred embodiment depicted in the Figures, the barrier wall section 56 of the lateral nose piece section 54 includes two exhaust orifices 58 and matching exhaust conduits/enclosed passageways 60.

Figure 2:
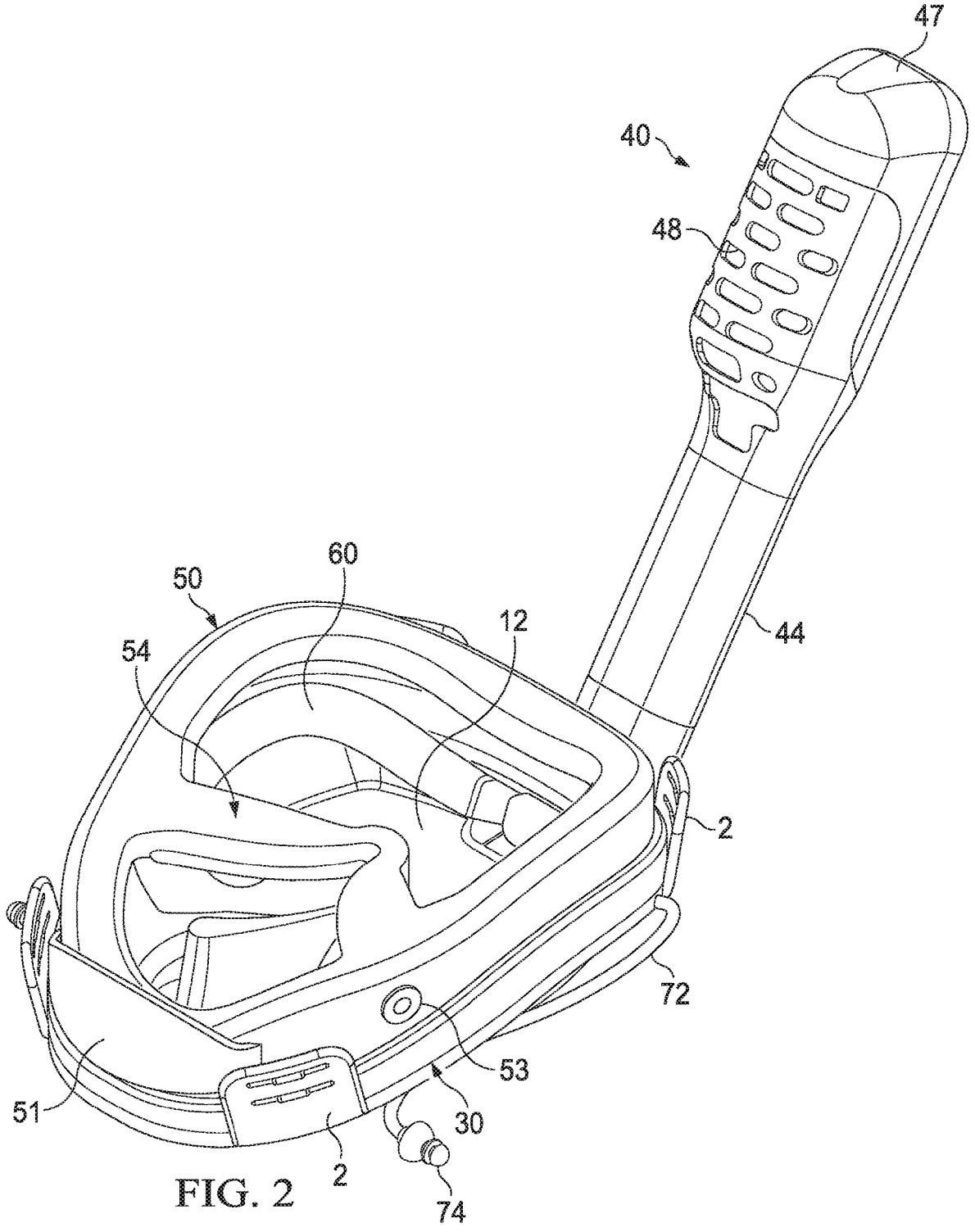
FIG. 2 is a rear perspective view of the snorkel mask in FIG. 1 with the elastic restraining straps removed.
Figure 3:
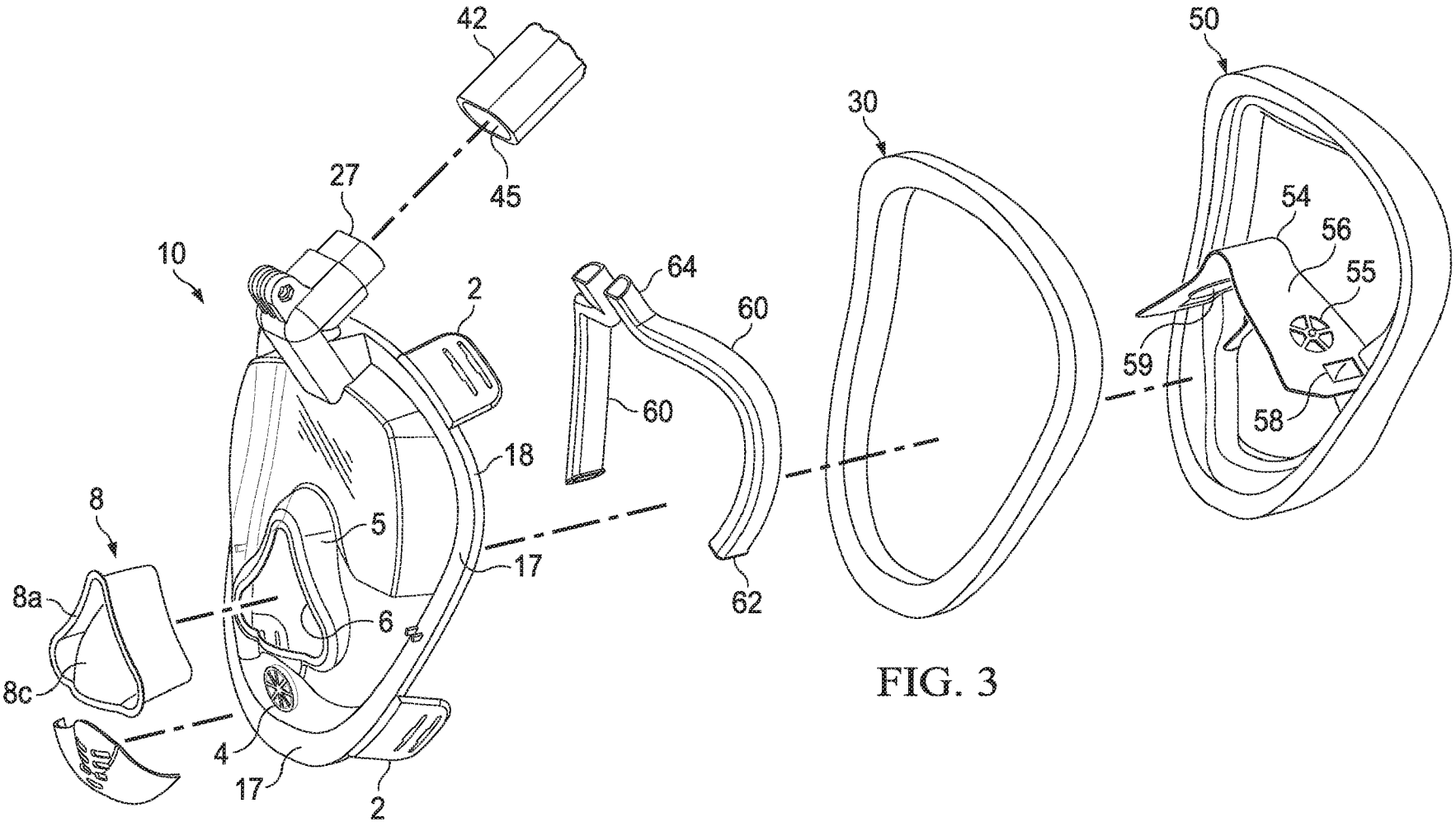
FIG. 3 is an exploded view of the snorkel mask in FIG. 2.
Figure 4:
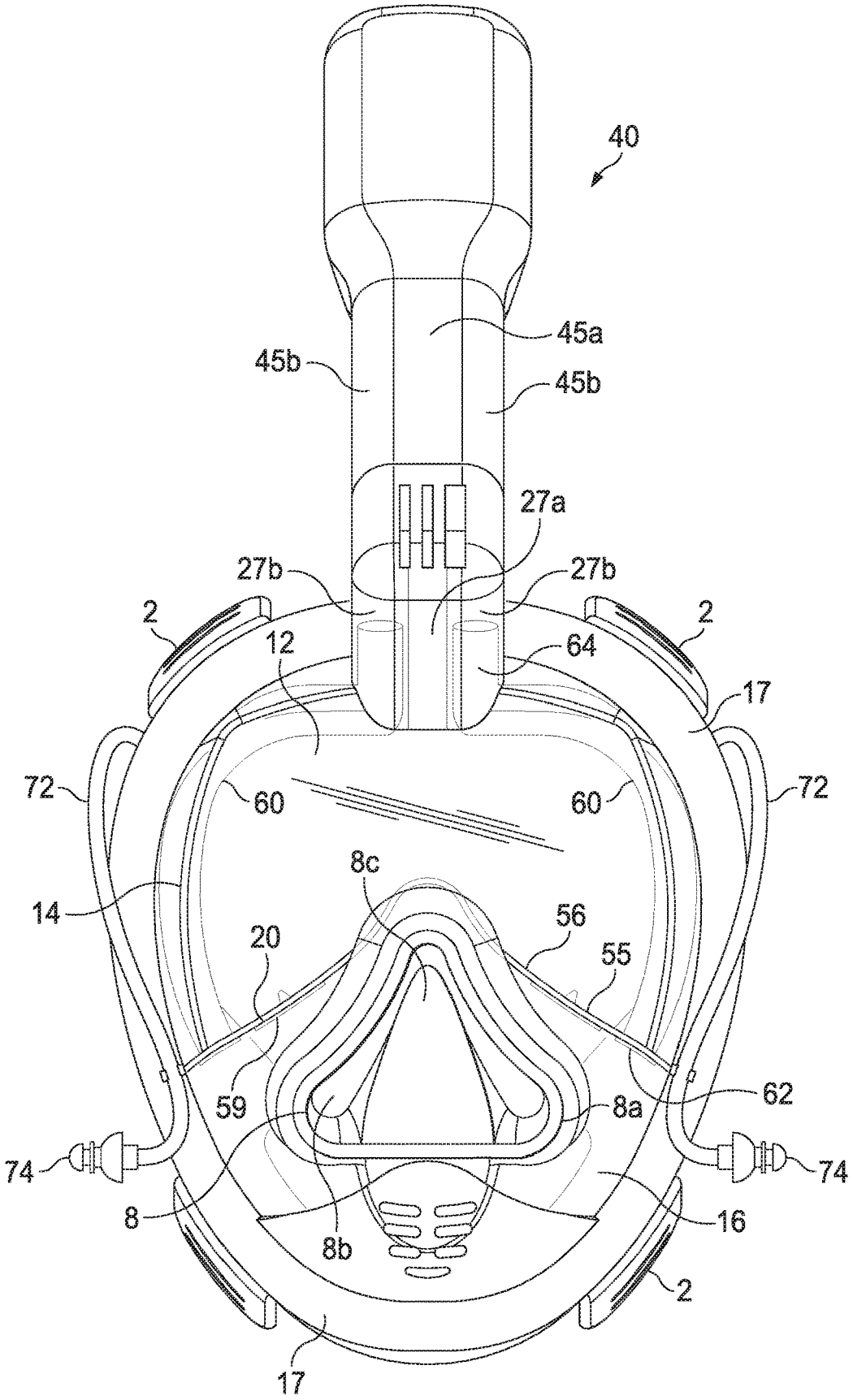
FIG. 4 is a front view of the snorkel mask in FIG. 2.
Figure 5:
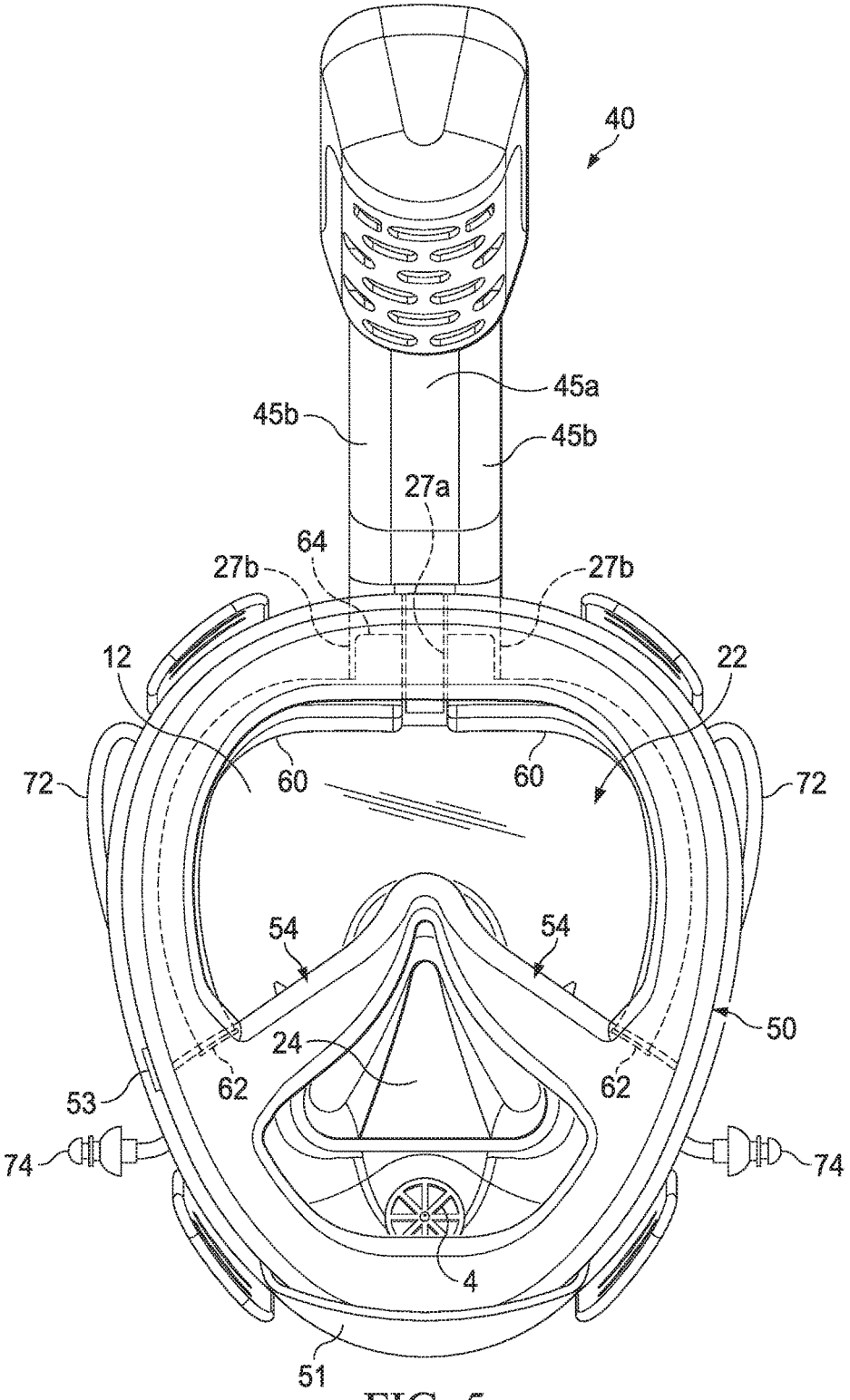
FIG. 5 is a rear view of the snorkel mask in FIG. 2.
Figure 6:
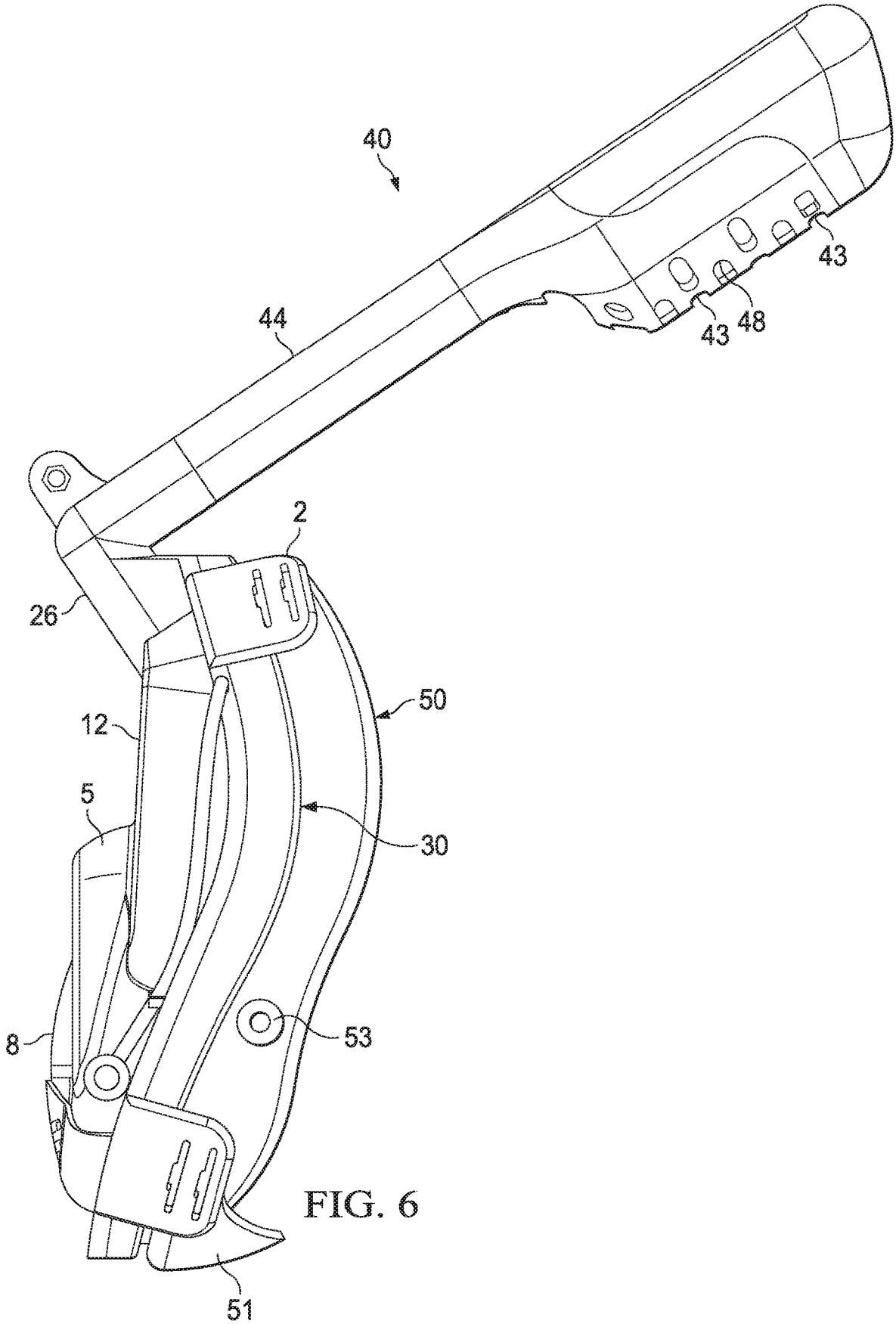
FIG. 6 is a side view of the snorkel mask in FIG. 2.

The flexible annular skirt 50 may also include a valve device 53 for varying the amount of cushioning substance in the hollow annular skirt 50. For example, the valve device 53 could be a simple air valve for increasing or decreasing the amount of air contained in the hollow annular skirt 50. The hollow annular skirt 50 may further include a chin guard 51 configured at the bottom of the mask 100. As depicted in FIGS. 2 and 6, the chin guard 51 extends towards the back of the mask providing protection for the user's chin and assisting in maintaining the proper alignment and positioning of the mask on the user's face.

A snorkel device 40 is connected via the snorkel coupling 26 formed in the upper portion 14 of the faceplate 10. The snorkel device 40 may include a ventilation system that provides an air pathway into and out of the mask 100. In a preferred embodiment, the snorkel device 40 comprises an elongated body 44, which slidably couples to the snorkel coupling 26 on one end 42, and includes an air-permeable enclosure 48 on the distal end. The elongated body 44 encloses an air passageway 45 which fluidly connects a passageway 27 in the snorkel coupling 26 with the airway inlet 43 near the distal end 46 of the snorkel device 40.

The snorkel device 40 may have a distal end 46 having an air-permeable enclosure 48 containing an air inlet 43. The snorkel device 40 may further comprise a shut-off device that is mobile within the enclosure so that when the snorkel device 40 is submerged in water the shut-off device is caused to move and close the inlet to the air passageway 45 in the snorkel device 40. Nonetheless, the snorkel device 40 is constructed so that when a user exhales air while under water the inlet 43 may be momentarily forced open to exhaust the air.

When the snorkel device 40 is out of the water, the shut-off device does not cover the inlet to the air passageway 45 in the snorkel 40 allowing fresh air be inhaled through the air passageway 45 and into the upper chamber 22 of the mask 100, through the intake apertures 55 and past check valve 59 into the lower chamber 24. In a preferred embodiment, the snorkel device 40 is detachable from the snorkel coupling 26 formed in the upper portion 14 of the faceplate 10.

Figure 7B:
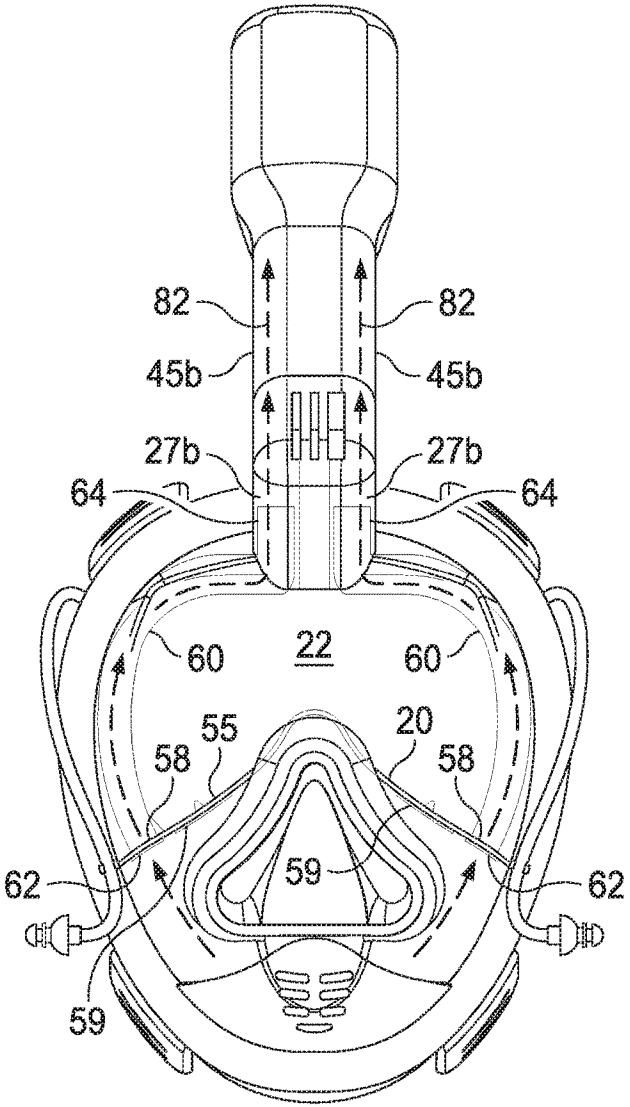
FIG. 7B illustrates the exhale air circuit of the snorkel mask of the present invention.
Figure 7A:
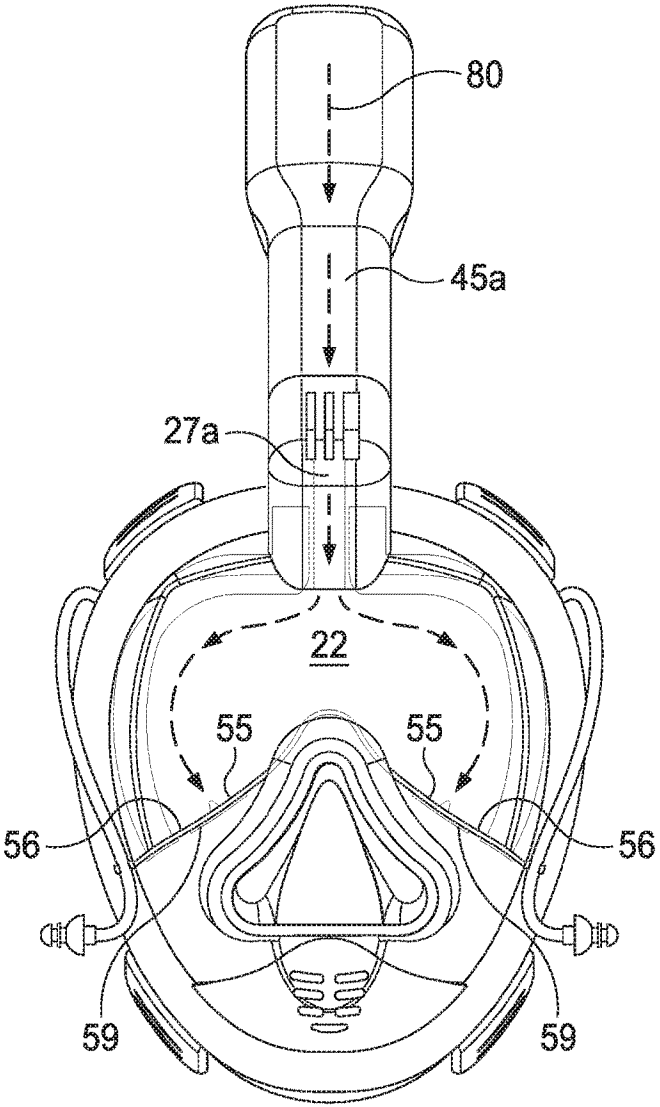
FIG. 7A illustrates the inhale air circuit of the snorkel mask of the present invention.

As shown in FIG. 7A, during the inhalation cycle fresh air 80 enters through the airway inlet 43 near the distal end 46 of the snorkel device 40 device and proceeds through the air passageway 45 to the passageway 27 of the snorkel coupling 26, into the upper chamber 22, through the aperture 55 in the barrier wall section 56 and into the lower chamber 24 of the mask 100. As shown in FIG. 7B, during the exhalation cycle the check valve 59 of aperture 55 automatically seals forcing the exhaled air 82 to proceed up and through the enclosed passageway of the exhaust conduit 60 to the passageway 27 of the snorkel coupling 26, and onto the air passageway 45 of the snorkel device 40 where it exhausts out of the airway inlet 43 near the distal end 46 of the snorkel device 40.

In a preferred embodiment, the snorkel coupling 26 and the snorkel device 40 provides separate pathways or channels for inhaled and exhaled air. For example, with reference to FIGS. 7A and 7B, the air passageway 45 of the snorkel device 40 is divided into inlet 28 and exhaust 29 channels. The inlet 28 and exhaust 29 channels of the snorkel device 40 are properly aligned with corresponding air inlet passageway 27*a* and the exhaust air passageways 27*b* formed in the passageway 27 of the snorkel coupling 27 formed in the upper portion 14 of the faceplate 10 of the mask 100. As shown in FIG. 7A, the inhalation cycle fresh air 80 enters the snorkel device through the airway inlet 43 near the distal end 46 of the snorkel device 40 device and proceeds through the inlet air channel 45*a* to the inlet passageway 27*a* of the snorkel coupling 26, into the upper chamber 22, through the aperture 55 in the barrier wall section 56 and into the lower chamber 24 of the mask 100. As shown in FIG. 7B, during the exhalation cycle the check valve 59 of aperture 55 automatically seals forcing the exhaled air 82 to proceed up and through the enclosed passageway of the exhaust conduit 60 to the exhaust air passageway 27*b* of the snorkel coupling 26, and onto the exhaust air channel 45*b* formed in the passageway 45 of the snorkel device 40 where it is directed to the airway inlet 43 near the distal end 46 of the snorkel device 40.

The flexible hollow skirt 50 and the flexible insert 8 of the faceplate 10 are preferably made of silicone while the frame 30 and faceplate 10 may be made of rigid plastic such as polypropylene or polycarbonate. The arrangement is advantageous since it allows a mask 100 to be manufactured using a minimum number of parts. Preferably the parts are fused together using injection molding techniques to create a unitary mask body.

The mask 100 of the present invention may also comprise an elastic retention strap 70 which extends between the two or more buckle devices 2 incorporated into the faceplate 10 of the mask 100. In a preferred embodiment shown in FIG. 4, the mask 100 includes two buckle devices 2 extending from the upper portion 14 of the faceplate 10 and two buckle devices 2 extending from the lower portion 14 of the faceplate 10.

In a preferred embodiment, the elastic retention strap 70 may comprise two elastic retention straps bonded together in the center of both straps, where each of the straps 70 is attached to a buckles 2 on the same side of the mask and configured on the upper 14 and lower portion 16 of the faceplate 10. For example, a first elastic retention strap 70 having one end attached to a buckle device 2 extending from the upper portion 14 of a first side of the faceplate 10 and a second end attached to a buckle device 2 extending from the lower portion 16 of a first side of the faceplate 10. A second elastic retention strap 70 having one end attached to a buckle device extending from the upper portion of a second side of the faceplate and a second end attached to a buckle device extending from the lower portion of a second side of the faceplate. The configured elastic straps are, therefore, X-shaped making it possible to cover the rear part of the user's head, thereby providing stability while maintaining of the mask snugly on the user's head and face. This preferred embodiment facilitates the mounting operation of the elastic strap and the holding in place thereof in relation to the mask.

Finally, the mask may further include ear buds or earplugs 74 for sealing the user's ears. The earplugs 74 are attached to the mask 100 by means of connecting straps 72 attached to the faceplate 10.

Throughout the description, including the claims, the term "comprising a" should be understood as being synonymous with "comprising at least one" unless otherwise stated. In addition, any range set forth in the description, including the claims should be understood as including its end value(s) unless otherwise stated. Specific values for described elements should be understood to be within accepted manufacturing or industry tolerances known to one of skill in the art, and any use of the terms "substantially" and/or "approximately" and/or "generally" should be understood to mean falling within such accepted tolerances.

It will now be evident to those skilled in the art that there has been described herein an improved snorkel mask. Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention.

I claim:

1. A snorkel mask comprising: a faceplate having a partition delineating an upper and lower section, said upper section comprising a transparent lens section and said lower section comprising a purge valve and a cutout section having a flexible insert, said faceplate having a flange formed along the outer periphery of said faceplate, said upper section having a snorkel coupling defining a passageway through a portion of a lens of said transparent lens section to an upper chamber; a rigid frame bonded to said flange; a flexible annular skirt fixed to said rigid frame, the skirt being hollow and filled with a cushioning substance, the skirt comprising a lateral nose piece section attached to the partition and forming the upper chamber and a lower chamber, said lateral nose piece having a barrier wall section defining and sealing off the upper chamber from the lower chamber, said lateral nose piece being arranged for bearing upon the top of a user's nose when the mask is worn by the user so that the user's mouth and nose are located in the lower chamber, wherein the barrier wall section includes at least one aperture arranged to allow the movement of air from the upper chamber to the lower chamber during an inhalation phase, and the barrier wall section further includes at least one exhaust orifice containing an exhaust conduit extending from the lower chamber through the upper chamber to the snorkel coupling passageway to allow the movement of exhaled air from the lower chamber through the upper chamber to the snorkel coupling passageway during an exhalation phase.

2. The snorkel mask of claim 1, wherein the at least one aperture has a matching check valve that opens the aperture during the inhalation cycle and closes the at least one aperture during the exhalation cycle.

3. The snorkel mask of claim 1, wherein the cushioning substance comprises a gas.

4. The snorkel mask of claim 1, wherein the cushioning substance comprises a gel material.

5. The snorkel mask of claim 1, wherein said flexible annular skirt further comprises a valve device for varying the amount of cushioning substance in the hollow annular skirt.

6. The snorkel mask of claim 1, wherein said faceplate further comprises two or more buckle devices for attaching an elastic retention strap to the mask.

7. The snorkel mask of claim 1, further comprising two earplugs attached to opposing sides of said snorkel mask by connecting straps.

8. The snorkel mask of claim 1, wherein said at least one aperture comprises two apertures having matching check valves.

9. The snorkel mask of claim 1, wherein said at least one exhaust orifice comprises two exhaust orifices having matching exhaust conduits.

10. The snorkel mask of claim 1, wherein the snorkel coupling passageway includes separate intake and exhaust channels.

11. The snorkel mask of claim 1, wherein the snorkel coupling passageway connects to an air passageway of a snorkel device.

12. The snorkel mask of claim 1, wherein said rigid frame is contained within the circumference of an outer periphery of the faceplate.

13. The snorkel mask of claim 1, wherein said faceplate and rigid frame are constructed of a rigid plastic.

14. The snorkel mask of claim 13, wherein said rigid plastic comprises polycarbonate.

15. The snorkel mask of claim 1, wherein said flexible insert and flexible annular skirt are constructed of silicone.

16. The snorkel mask of claim 1, wherein said faceplate, rigid frame and flexible annular skirt are fused together using injection molding techniques to form a unitary mask body.

17. A faceplate for a full-faced snorkel mask, comprising: a rigid body having a lateral partition on an interior surface delineating an upper and lower section, said upper section comprising a transparent lens section and said lower section comprising a region that extends away from the transparent lens section that includes a purge valve and a cutout section fitted with a complementary shaped flexible insert that enables a user to grasp the user's nose, said faceplate having a flange formed along the outer periphery of said rigid body for receiving a rigid frame, said upper section having a snorkel coupling defining a passageway through said upper section; wherein said passageway defined by said snorkel coupling passes through a portion of a lens of the transparent lens section.

18. The faceplate of claim 17, wherein said flexible insert comprises an outer peripheral edge bonded to the cutout section, a thin-walled recessed portion and a thin-walled bulbous nose section.

19. The faceplate of claim 17, further comprising two or more buckle devices for receiving an elastic retention strap.

20. The faceplate of claim 17, wherein the snorkel coupling passageway connects to an air passageway of a snorkel device.

21. The faceplate of claim 17, wherein the snorkel coupling passageway includes separate intake and exhaust channels.

* * * * *